United States Patent [19]

Hurxthal

[11] Patent Number: 4,567,682

[45] Date of Patent: Feb. 4, 1986

[54] MOBILE SCULPTURE AND KIT FOR MAKING

[76] Inventor: Peter W. Hurxthal, 404 Sandwich St., Plymouth, Mass. 02360

[21] Appl. No.: 575,459

[22] Filed: Jan. 30, 1984

[51] Int. Cl.[4] ..... G09F 7/22

[52] U.S. Cl. ..... 40/617

[58] Field of Search ..... 40/617, 604; 446/227; 24/129 R, 129 D

[56] References Cited

U.S. PATENT DOCUMENTS

| | | | |
|---|---|---|---|
| 1,635,071 | 7/1927 | Comstock | 47/47 |
| 2,650,448 | 9/1953 | Lichtig . | |
| 2,854,774 | 10/1958 | Horwitt | 40/155 |
| 3,350,045 | 10/1967 | Mayers | 52/DIG. 4 |
| 3,533,184 | 10/1970 | Kerr | 24/129 R |

FOREIGN PATENT DOCUMENTS

| | | | |
|---|---|---|---|
| 2746628 | 4/1979 | Fed. Rep. of Germany | 40/617 |

*Primary Examiner*—Gene Mancene
*Assistant Examiner*—Cary E. Stone
*Attorney, Agent, or Firm*—Herbert L. Gatewood

[57] ABSTRACT

A mobile sculpture and kit for its manufacture are provided wherein a plurality of pairs of photographs, in back-to-back relationship, with respect to one another, are suspended in air, in spaced-apart location, each pair of photographs being removably replaceable from a holder for the pair of photographs so that other pairs of photographs can be substituted from time-to-time.

6 Claims, 7 Drawing Figures

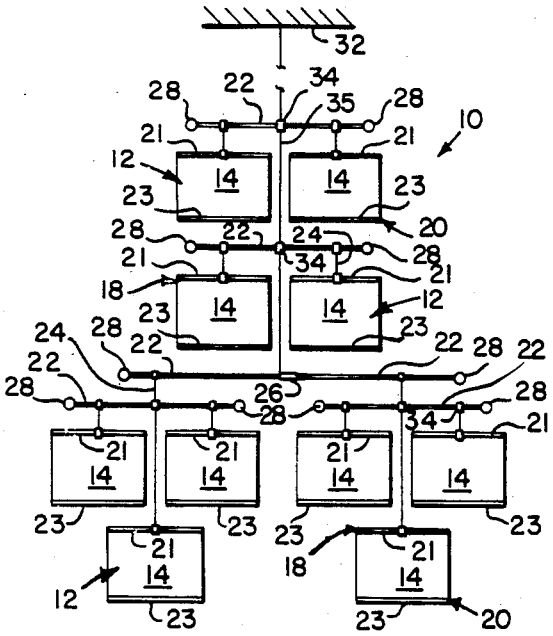
Fig. 1A
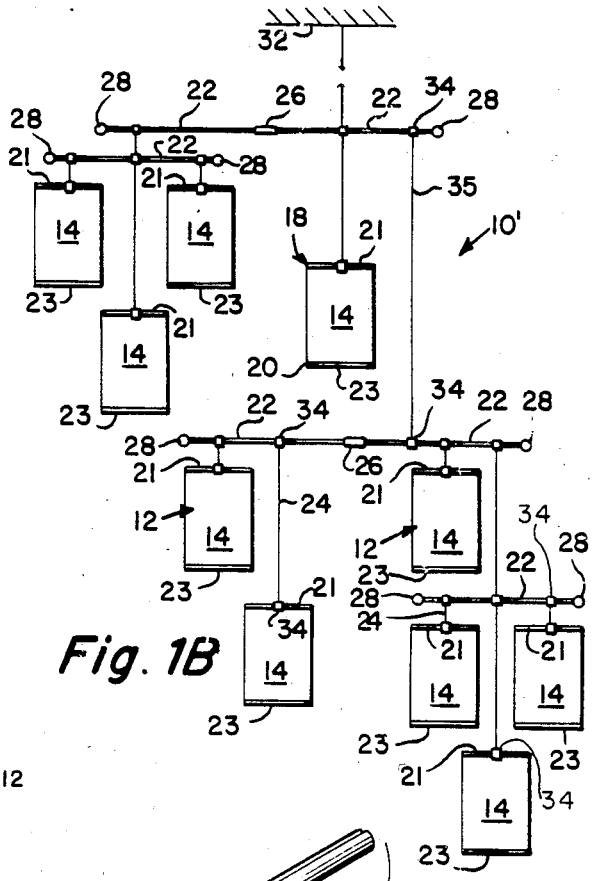
Fig. 1B
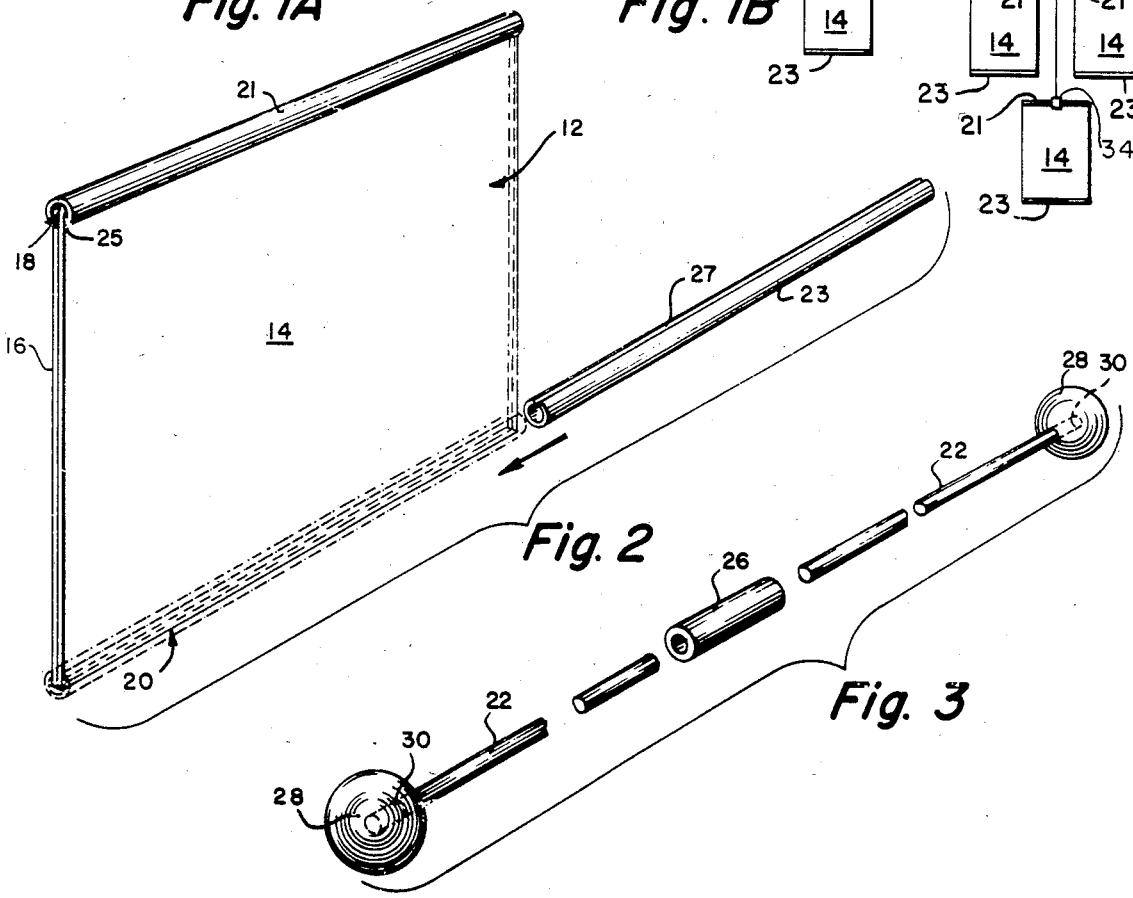
Fig. 2
Fig. 3

MOBILE SCULPTURE AND KIT FOR MAKING

BACKGROUND OF THE INVENTION (a) Field of the Invention

This invention relates to a mobile sculpture and to a kit comprising the components for creating various configurations and constructions of such a sculpture.

(b) Decription of the Prior Art

Over the years, a variety of abstract sculptures, termed mobiles, have been created and constructed. One aim of such a sculpture is to depict movement, i.e., kinetic rather than static rhythms. This is done, in general, by an arrangement of thin forms, rings, rods, etc. suspended in mid-air, generally from the ceiling of a room, by fine wires, thread, or the like.

As an art form, these mobile sculptures have been found quite useful and satisfying for a variety of decorating purposes. However, as far as I know, none of the mobile sculptures created heretofore have provided for the display from time-to-time of different photographs, scenic cards and the like.

SUMMARY OF THE INVENTION

In accordance with the more general aspects of my invention there is provided a mobile sculpture wherein a plurality of pairs of photographs, scenic cards, and the like are suspended in mid-air.

Quite advantageously, the construction of the mobile sculpture of my invention makes it possible from time-to-time, as desired, to replace the photographs and the like being then displayed, with other such items. Thus, the mobile of the invention provides not only more effective usage but the mobile as a source of interest and enjoyment can be better maintained and is renewed continuously.

A further and unique advantage in another aspect of my invention is that components for creation of various and different mobile configurations and constructions are provided in a kit. This makes it possible for a person not only to display various and different photographs and the like, as desired, but also to create mobile constructions, displaying a greater number or fewer number of photographs, etc., when wanting to do so.

Thus, there is provided in accordance with the basic aspects of the invention a mobile sculpture displaying a plurality of spaced apart, suspended in mid-air planar members or defined shape having at least one linear edge, said sculpture comprising a plurality of relatively inflexible, horizontally disposed elongated support members each of predetermined length, first means attached to each of said support members for suspending each said support member individually in mid-air in spaced apart relationship to the other support members and for connecting together said support members as a unit in a predetermined mobile configuration, a plurality of horizontally disposed elongated means each of predetermined lesser length than said support members, an elongated groove being provided in each said elongated means for holding and maintaining the linear edge of each said plurality of planar members, and second means for attachment to each said plurality of elongated means and to one of said horizontally disposed elongated support member for maintaining the plurality of said planar members in the desired suspended configuration.

In accordance with a further aspect of the invention there is provided a kit for creation and construction of various designs and configurations of a mobile sculpture displaying a plurality of spaced apart, suspended in mid-air planar members of defined shape each having and being defined by at least one linear edge, said kit comprising a plurality of elongated support members all of the same predetermined length, said support members being characterized by their relative stiffness and resistance to bending when supporting said planar members in the finished mobile sculputre, a plurality of connecting sleeves for connecting together the ends of two said support members for providing a support member of greater length, a plurality of elongated clamping means of predetermined lesser length than said support means each being provided with an elongated groove for holding and retaining the linear edge of each said planar member, and means for connecting together said support members and said elongated clamping means in a mobile sculpture of desired configuration.

BRIEF DESCRIPTION OF THE DRAWING

The novel features and operation of the present invention will be better understood by reference to the drawing, in conjunction with reading the following specification, in which:

FIG. 1 is a diagrammatic view showing in FIG. 1(*a*) one particular construction and configuration of a mobile according to the invention and in FIG. 1(*b*) a mobile of different configuration and construction;

FIG. 2 is a view in perspective showing the preferred clamping means according to the invention and its engagement with the upper and bottom horizontally disposed edges of a pair of photographs;

FIG. 3 is a view in perspective showing two support members of the invention being connected together by a connecting sleeve;

DETAILED DESCRIPTION OF THE INVENTION AND THE PREFERRED EMBODIMENTS

Figure 5:
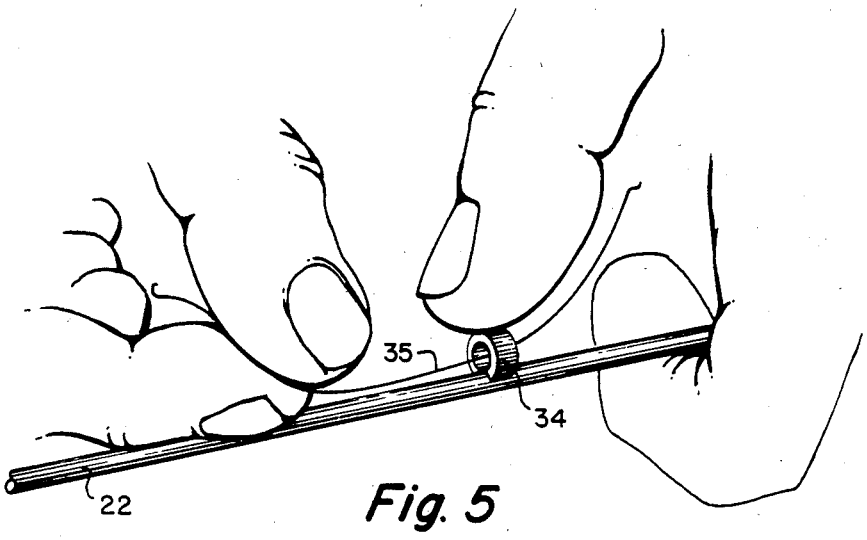
FIG. 5 is a view in perspective showing how the "C" clip shown in FIG. 4 can be pushed by hand onto, and in engagement with, an elongated support member.

Turning now to the drawings, there is shown in FIG. 1 thereof, in accordance with the invention, a mobile 10 in FIG. 1(*a*) of one particular design and configuration and a mobile 10′ in FIG. 1(*b*) of a somewhat different design and construction. Nevertheless, regardless of that particular design and configuration that a mobile sculpture according to the invention takes, each different mobile constructed will be comprised of the same basic components; accordingly, to avoid confusion and to simplify the disclosure of the invention herein, reference will be made, in particular hereinafter, only to that mobile designated by reference numeral 10, in FIG. 1(*a*).

As shown in FIG. 1(*a*) the mobile 10 comprises a plurality of pairs 12 of photographs 14, 16, each pair of which is suspended in mid-air, as hereinafter more fully described, and is spaced apart in a desired location from another pair. The photographs in each pair are arranged, or disposed, in back-to-back relation to one another so that the subjects carried on the faces of the photographs will be displayed by and as a part of the mobile sculpture. It will be appreciated, however, that instead of these photographs, other thin planar members can be used such as scenic post cards and the like, the only requirement being that whatever such members are used and displayed in the mobile that they be not only planar but also of relatively light weight such as a photograph. Of critical importance with respect to the invention is that such planar members be defined by at least one linear edge, the reason for which will be made clear hereinafter. Moreover, it will also be appreciated, and from the disclosure which follows, that instead of two such members being used, one member on occasion may suffice, as desired. However, the invention will be more particularly disclosed as if members 14, 16 are photographs to be displayed.

As will be seen from reference to FIGS. 1 and 2, each pair 12 of photographs 14, 16 in mobile 10 is held together adjacent the top and bottom edges 18, 20 thereof, by clamping means 21, 23, respectively, which, in the most preferred aspect of the invention, are removably engaged with the paired photographs, as hereinafter more fully described. However, it will be appreciated that these clamping means may be fixedly secured, if this is desired, but such a feature is less preferred as it does not allow for repeated usage from time-to-time in the creation of differently constructed mobiles, as is contemplated by this invention.

The pairs 12 of photographs or the like are, as shown in FIG. 1(*a*), each suspended in mid-air from a horizontally disposed elongated support member or rod 22, located above the pairs of photographs, by means of a suspension means 24 interconnected with the upper disposed support member 22 and a clamping means 21, clamping and holding the pair of photographs. Elongated support members 22 which, in the practice of the invention, are of predetermined length, can be of various lengths, as desired; however, for sake of convenience, standardization, and distribution in kit form, elongated support members 9 inches in length have been found quite suitable for use. Where it is desired, however, to create a mobile with a greater length support member, two support members 22 can be joined together end-to-end, using a connecting sleeve 26, as may more clearly be seen by reference to FIG. 3 of the drawing.

Connecting sleeves 26 can be manufactured of various material, e.g., wood, metal, paper, plastic, etc.; however, connecting sleeves of conventional plastic material, for example, polyvinyl chloride, are most desired. Connecting sleeves 26, which, as can be seen by reference to FIG. 3, are of tubular shape, can be readily extruded from various plastic materials, according to known techniques, and provided of any dimension and color desired. The inner diameter of any particular connecting sleeve 26 used in the invention will depend on the outer diameter of support rod 22; however, the ends of the support rods connected together should fit snugly into the connecting sleeve 26 so as not to accidentally become detached from one another during use. The length of connecting sleeve 26 can also vary somewhat but it should be long enough, e.g., about ½" to 1", to hold the two support rods together, and in good alignment with one another during use. When two support rods 22 are joined together by a connecting sleeve 26, the newly formed longer support rod should be capable of supporting the pairs 12 of photographs or the like without bending at the connection. It will be appreciated, of course, that any length tube desired, and of the correct dimensions, can be extruded from a suitable plastic composition and then cut into connecting sleeves of the most suitable length.

The elongated support rods 22 can be provided of various materials, e.g., wood, plastic, or metal, and can be provided of various colors, as desired. In the practice of the invention, support rods 22 have been of a bright finish aluminum wire about 0.110" in diamater. Such support rods will be relatively light in weight yet sufficiently stiff and inflexible as to maintain their linear shape in use, according to the invention, as a mobile component for pairs of photographs. However, it will be appreciated that support members 22 need not be of wire or rod stock but can, instead, be tubular, if desired. Moreover, these support members can also, if desired, be extruded from various plastic materials, e.g., nylon, polyvinyl chloride, polypropylene, etc., conventionally used for forming plastic rods, tubes, etc. The only requirement for a support rod of plastic, or of any other material, is that it be sufficiently stiff so that it does not unduly bend when pairs of photographs are suspended from it. Naturally, the larger the number of photographs that are contemplated to be suspended from a rod, the more inflexible the rod should be.

Neither is it a necessity of this invention that the elongated support rods used be of cylindrical cross-section, as is shown more particularly in the drawing. This is preferred, however, for sake of convenience in manufacture, economy, and ready availability; however, the cross-section of the elongated support rods can be other than circular or cylindrical, for example, the support rods can be of irregular shape such as polygonal.

As will be seen by reference to the drawing, in particular FIGS. 1(*a*) and 3, the ends of support members 22 are capped by spherical shaped end members 28 each of which is provided with a suitably dimensioned dead bore 30, into which the end of the support member intrudes. As with connecting sleeve 26, the diameter of bore 30 should be such as to provide a good friction fit with the support rod 22, however, if desired, end member 28 can be secured to the support rod with a suitable adhesive.

End members 28 can be provided of various materials, as desired, for example, plastic, glass, wood, metal, etc. These members are primarily for decorative purpose; however, as will be appreciated, capping the ends of the support members in this manner also provides for a somewhat safer product. The dead bore 30 in end member 28 can be provided therein during manufacture, in the case of a plastic end member, or drilled therein subsequent to manufacture, if the end members are a sphere of metal or glass. The depth of bore 30 need extend into the end member a sufficient depth to allow the end of the support rod to intrude about ⅛" or more into the bore. The cross-section of bore 30 in each end member 28 will, or course, depend somewhat on the particular cross-section of support member 22, for example, where the cross-section of support member 22 is circular, the cross-section of dead bore 30 should desirably also be circular. As will be appreciated, however, end member 28 need not be of spherical shape, as is shown in the drawing. It can be of any ornamental shape desired, e.g., cubic or of irregular shape such as octagonal. Also, although end members 28 are shown in the drawing as being provided with a dead bore 30, it will be appreciated that the bore can extend entirely through, e.g., diametrically, the end member.

The clamping means 21, 23 are of identical construction and, most preferably, as best shown in FIG. 2, comprise elongated members having a rounded "C" cross-section thus providing channels or grooves 25, 27, respectively, along their entire lengths. A clamping means having such a shaped cross-section, depending of course somewhat on the material used, allows for some give or expansion in the width of the narrow portion of the groove, defined by the ends of the "C", on insertion of the photographs into the groove. The ends of the "C", as will be appreciated, which form the narrowest part of the groove or channel, press against the faces of the photographs inwardly from and adjacent their edges. It is this pressure that maintains and holds the photographs in the clamping means. Accordingly, it will be appreciated that the material of the clamping means must also be characterized by its property of returning to its original shape, once the groove opening is widened, e.g., spread apart. As will be appreciated, the photographs are clamped along a line adjacent their edges, the location of that line being determined by the size of the "C" shaped clamping means and how far into the clamping means that the edges of the photographs intrude.

The clamping means 21, 23 of the invention can be provided of various materials; however, these clamping means are preferably of conventional plastic compositions such as nylon, polyvinyl chloride, etc. Accordingly, the clamping means can be extruded, as shown in FIG. 2, with a rounded "C" cross-section, providing in the length thereof a channel or groove for location of the edges of the paired photographs, cards, etc. However, it will be appreciated that clamping means 21, 23 need not be manufactured of plastic or be even of a rounded "C" cross-sectional shape. The important consideration is that an elongated member be provided having a channel or groove therein for holding the edges of the photographs, as shown in the drawing, and that the grooved member have sufficient flexibility, shape retention and spring, and be of the required dimensions and construction to provide a clamping action against the photographs adjacent and inwardly of their edges, sufficient to prevent the pair of photographs from accidently being separated from the clamping means during use, i.e., once the mobile 10 has been constructed and is in place, suspended from the ceiling or other support for the mobile. Thus, the width of the elongated groove, in this case the distance between the ends of the "C", in any clamping means must be of a dimension slightly less than the thickness of two photographs paired together back-to-back to provide for the clamping action. And the width of the groove at its narrowest point must be uniform along the length of the clamping means to best provide the same and uniform clamping pressure against the face of the photographs adjacent the edge along their entire length.

Clamping means 21, 23 can also be provided of metal and be more U-shaped, if desired, instead of "C" shaped in cross-section, as is shown in FIG. 2, the bottom of such a U-shaped clamping means being either curved of flat. In such a case, the important thing is that the metal be flexible and have spring and that the sides or legs of the U-shaped clamping means forming the groove be bowed or curved inwardly, or that a narrow constriction or bead be provided within the elongated groove, so as to press against and clamp together the intruding photographs on a line adjacent their edges, yet be flexible enough that pairs of photographs can be removed and inserted, as desired.

Whatever the cross-sectional shape of such a clamping means as will be found suitable in the practice of this invention, the groove provided therein for insertion of the photographs should be deep enough to allow the edges of the photographs to intrude to a depth of at least 1/32" or more. The farther from the edge that the line is on the photograph that is actually gripped, assuming there to be good gripping pressure, the less likely that the photograph will become dislodged from the clamping means during use in any particular mobile construction. Likewise, the greater the surface area of the clamping means in contact with the face of the photographs, the less likely the photograph will slip out of the clamping means. The clamping means used in the practice of this invention was a white plastic tube-like body measuring 5 ⅛" in length, having an outside diameter of 0.110", and an inside diameter of 0.50". The channels 25, 27, looking at the clamping means in cross-section, are defined by planar sidewalls which taper inwardly toward the center from an outside chord of 0.020" to an inside chord of 0.016".

A somewhat lesser desired clamping means 21, 23 may be satisfactory for use in some cases and need not have the flexibility and spring properties of the more preferred and desired clamping means disclosed heretofore. Thus, clamping means 21, 23 can be of a rigid construction, e.g., an elongated member having U-shaped cross-sction, the legs of which providing and defining the groove being spaced apart only sufficient to accommodate the thickness of two photogrpahs, or other planar member, or members, to be inserted. In this case, the clamping means can be secured to the pair of photographs by either suitable adhesive or mechanical fastening means inserted laterally thereto, e.g., rivet like members or pins. However, this construction of a clamping means is much less desired as it does not allow for repeated use of the clamping means with other pairs of photographs, as contemplated by the preferred aspects of this invention. To use other photographs in a mobile construction with such clamping means may require the obtaining of additional clamping means, as such clamping means cannot be re-used if adhesive is used to secure the photographs in the clamping means. Moreover, the photographs clamped with the lesser desired, clamping means construction using adhesive will have to be cut at their edge, for removal from the clamping means. The clamping means will not be reusable, as will be appreciated, and will need be discarded. Even if removable pins are used with the lesser desired clamping means construction, this will necessitate holes being punched in the edges of the photographs, which may be undesirable in some cases.

Figure 4:
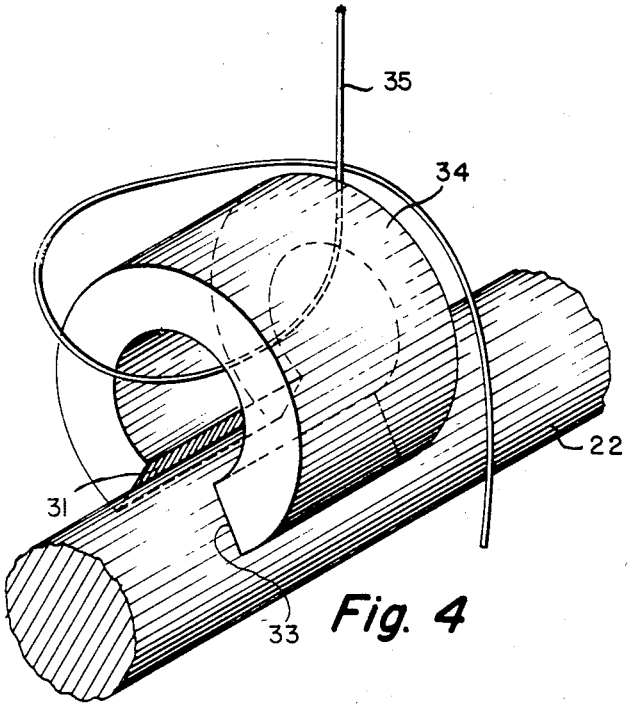
FIG. 4 in perspective showing the end of a filamentary suspension means being inserted through a "C" clip according to the invention which is being positioned on an elongated support member.

Various means, as will be appreciated, can be used for connecting together and suspending the support members, in the desired spacial configurations, to connect the elongated means to and suspend them from the support members, and to connect and suspend the mobile sculpture created from an overhead support means such as the ceiling or the like, shown by reference numeral 32 in FIGS. 1(*a*) and 1(*b*). For example, the support members can be connected together by predetermined lengths of thin strips of metal or plastic, or of fabric, the strips being provided with hooks at each end for engagement with a support member. Similarly, the means for connecting the elongated clamping means to a support member can be such thin strips of material provided at each end with a hook. In this case, each elongated clamping means could be provided with an eye for engagement with one of the hooks. However, the most preferred connecting means comprises flexible filamentary material such as common sewing thread, either cotton or mixed blends such as polyester/cotton. The thread found most suitable for use in the practice of the invention should be relatively heavy or coarse, but other sizes may also be used, if desired. In the case of finer sized threads, it may be necessary, however, to wrap the thread once around the clip means 34, as hereinafter further described, and as is shown in FIG. 4.

Figure 6:
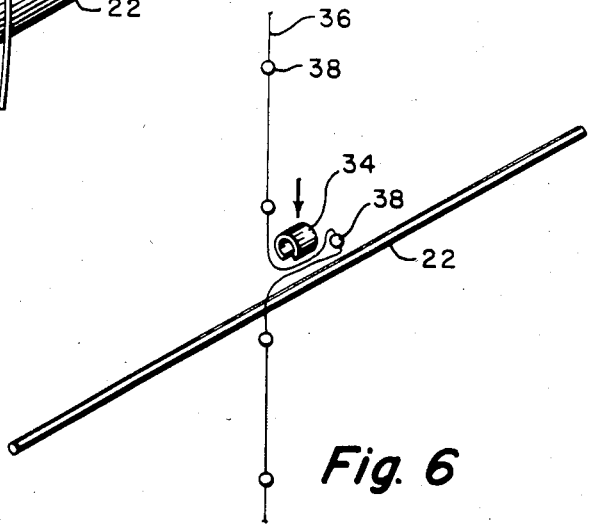
FIG. 6 is a view in perspective showing the use of an alternative filamentary suspension means in association with an elongated support member.

The ends of the filamentary material providing suspension means 24, 35 for connecting elongated clamping means 21 to a support member 22, and support members to one another, respectively, as shown in FIG. 1(*a*) are secured to the respective support member 22 and clamping means 21 by clip means 34, the preferred configuration of which is best seen by reference to FIGS. 5, 6. As shown therein, clip means 34, like clamping means 21, 23, is of a rounded "C" shaped cross-section of a dimension conforming in part to the periphery of support member 22 (and also to elongated clamping means 21). The clip means 34 is provided of suitable plastic material and, as in the case of the elongated clamping means, can be conventionally extruded in continuous length and subsequently cut to the desired length. The length of clip means 34 can vary somewhat, however, a clip means about 3/16" in length will be found satisfactory. In the practice of this invention, I have used such a clip means having a 0.190" O.D. and an 0.100" I.D. The ends of the "C" shaped clip means are defined by planar faces 31, 33 which taper inwardly from an outside chord of 0.110" to an inside chord measuring 0.080". The purpose of the clip means, as will be appreciated, is merely to removably trap and hold in place, without slipping, the ends, or a length, of filamentary material.

Whatever the plastic material used for the manufacture of clip means 34, it will be appreciated that clip means 34 must be characterized by sufficient give and flexibility to allow it to be pushed onto, and in engagement with, support member 22 and, in some cases, the elongated clamping means 21. This can be readily accomplished by hand, as will readily be seen in FIG. 5. The material of the clip means must also allow for repeated flexing for use time-and-again without failure. It will be appreciated that once clip means 34 is pushed onto the support member that it readily returns to its original dimension and shape, providing relatively good clamping engagement with the support member periphery, trapping the length of filamentary material passed through the clip means. Where the filamentary material used is a somewhat finer thread some slippage may occur, due to the lack of satisfactory frictional resistance between the filamentary material, support member (or clamping means), and clip means. This can be prevented, however, by wrapping the filamentary material one or more times around the clip means. See, for example, FIG. 4. Accordingly, it is preferred to use a somewhat coarser thread that will provide better frictional properties. Further, and better frictional characteristics can be provided, preventing slipping of the filamentary material through the clip means in using plastic material for the clip means of low frictional properties, or providing a somewhat less smooth support member. An alternative is to provide on this support member at the location of the clip means a strip of pressure-sensitive adhesive tape.

In a further aspect of the invention, filamentary material 36 can be used, as shown in FIG. 6 This filamentary material is provided at predetermined spaced intervals with enlarged portions 38, the purpose for which will soon be explained. The filamentary material 36 can be a single plastic filament, in which case the enlargements can be provided during manufacture thereof, or of conventional cotton or mixed blend thread with such enlargements being provided subsequent to manufacture. As will be better appreciated by reference to the drawing, in the use of such a filamentary material 36, an enlarged portion 38 is trapped on one side of the clip means 34 better ensuring against slippage of the filamentary material relative to the clip means 34 and support member 22. Other advantages in using such filamentary material are that the beads are decorative, adding further to the pleasing and attractive appearance of the mobile sculpture, and as the beads can be spaced at equal measured lengths, this will provide for easier measurement of length for a piece of connecting material, without use of a ruler or the like. As will also be appreciated, the use of such filamentary material better provides for a single vertical axis in connecting two support members together, making for better spin of the mobile constructed.

The clip means, in the most preferred aspects of the invention, will be of the same configuration, size and material of construction, whether used with support members 22 or clamping means 21. However, as will be appreciated this need not be the case, and will depend on the particular support members and clamping means used, as heretofore disclosed, as well as their particular shape and dimensions. Where the rounded "C" shaped cross-section is used, however, for clip means 34, the ends 31, 33 of the "C" should be spaced apart from one another only a sufficient distance to allow for pushing the clip means into the support rod. This, as will be appreciated depends not only upon the flexibility of the clip means, but also somewhat upon the relative sizes of the clip means and support member (and clamping means). However, in general, it is desirable that a clip means encase a substantial portion, for example, about three-fourths of the support rod periphery.

In a desired, and further, aspect of the invention there is provided a kit including the various components of the mobile sculpture heretofore disclosed, for creating various and different designs and configurations of a mobile, as desired. Such a kit, in addition to including various components for construction of a mobile sculpture, will include also drawings and sketches of various finished mobile configurations, only two of which are represented in FIG. 1 of the drawing.

When creating a mobile sculpture in accordance with the invention, the first thing to do is to select from the different suggested configurations the particular size desired, i.e., that configuration that will display all the photographs that you wish to display. However, it will be readily appreciated that mobile designs and configurations different from those suggested in the kit can be created, following the disclosure herein.

The photographs chosen for use in the mobile should next be paired together with photos of like size and subject angle. For example, where the photographs selected are of rectangular shape, e.g., 3.5"×5.5", those showing the subject vertically in the long direction, i.e., one 3.5" edge will be the horizontal, should be paired with other photos showing the subject vertically in the long direction. However, in any particular mobile configuration pairs of photographs showing the subject vertically in the long direction can be intermixed with pairs showing the subject vertically in the shorter direction, provided the proper balance is maintained. Also, it will be possible, with proper balancing as hereinafter discussed to intermix pairs of photographs of different sizes, and photograph pairs having a square shape with those of rectangular shape. The paired photographs are disposed back-to-back so that a subject is always visible.

The paired photographs are then each combined with elongated clamping means 21, 23, as best seen in FIG. 2. This is accomplished by sliding the clamping means, as indicated by the arrow, onto the top and bottom edges of each pair of photographs. The intrusion of the photographs into the "C" shaped groove 27 (FIG. 2) causes the narrow part of that groove to spread apart, to accomodate the thickness of the two photographs. Once within the groove, the ends of the "C" press against the planar faces of the photographs, as the widened groove tends to return to its original dimension.

The elongated clamping means 21, 23 are desirably of the same length as the edges of the photographs being clamped. Accordingly, where the edge of the photograph being clamped is 5.5", the length of the clamping means should also be 5.5". However, though somewhat less desirable, as less of the edges of the photographs will be clamped, the clamping means can be of somewhat lesser length than the photograph edges. In this case, the clamping means should be adjusted lengthwise of the edge being clamped to be centered on the pair of photographs.

In case any of the pairs of photographs are loose in the clamping means whereby the photographs might possibly become detached from the clamping means while suspended in mid-air in the mobile construction, the thickness of that pair of photographs will need be built-up. This can be accomplished in several different ways. The preferred manner of increasing the thickness of the photographs is to put a piece of pressure-sensitive adhesive tape on the back of one, or both, of the photographs along the edges being clamped together. Or another photograph or piece of paper of the same size as the pair can be used as a "filler" between the two photographs being displayed.

Next, or prior to clamping the pairs of photographs, the order is not important, the support rods are laid out on the floor or other large flat work surface in the spatial manner shown in the mobile design selected. Connecting sleeves 26 can be used to connect together the ends of two support rods, as needed for the particular mobile design being created.

The clamped pairs of photographs are next located on the work surface, according to the design, taking care to allow about 1"-1.5" vertically between each pair of photographs and a support member 22 from which the pair is suspended or above which the pair is located vertically, or another pair 12 of photographs. However, as will be appreciated, this distance can vary somewhat depending on the particular size mobile involved, the size photographs and their orientation, and the requirements of balance.

Desirably, the suspension means 24 for a pair of photographs 12 will be located inwardly from the end of a support member 22 about 1", if the subject is disposed in the photograph in the shorter vertical direction. In the case where the subject is disposed in the photograph in the longer vertical direction, the suspension means should be located inwardly from the end of the support member about two inches. However, these dimensions are not critical and can be adjusted somewhat, as desired, taking into consideration the requirements of balance as hereinafter further discussed.

Where two support rods are located directly adjacent one another, as is shown in FIG. 1(*a*), a 2" space separating the two rods vertically will generally be found satisfactory. However, as previously disclosed, other measurements can be used. The suggested measurements, however, will serve as a guide and everything will more easily balance out in the end if the support rods, and pairs of photographs are spatially located on the work surface somewhat close to these given measurements.

Once the support rods and pairs of photographs are laid out on the flat work surface, as above disclosed, for any particular mobile configuration, the next step is to connect those mobile components together, using the rounded "C" shaped clip means and filamentary material provided. The latter is provided as a roll of sewing thread in the kit, preferably a relatively coarse thread, as this will result in less chance for slippage, once clipped to the support members or clamping means. A heavy duty thread such as so-called "button hole" thread (100% polyester) available from Belding-Lily, Inc. will be found quite satisfactory in the practice of the invention. Providing the filamentary material (suspension means 24, filamentary material 35) in the kit as a spool of continuous length permits the desired lengths of connecting material to be provided, by merely cutting suitable lengths from the roll or spool of thread, as and when needed. When cutting a length of thread for connecting a clamping means 21 to a support member 22, the length of thread cut should be about one inch longer than actually desired, to account for final adjustments later. One end of the length of thread is clipped to a clamping means 21, in a manner as is shown in FIG. 5, in clipping a length of thread to a support member. The end of the cut length will be inserted through the clip means 34, leaving about 1" sticking out on the other side, and the clip means pushed onto the clamping means thereby securing the end of the thread. The thread should, of course, be contacted by the back of the clamping means, i.e., away from the opening therein (see FIG. 5) to better make certain that it does not slip out of the clip means in use.

When connecting the mobile components together, however, and finalizing the configuration of the mobile, start at the top of the design and work vertically downwardly, i.e., as it will hang once connected together. The support members, i.e., the frame of the mobile, should be connected together before connecting the clamped pairs of photographs to the support members.

Start by tying a small loop in the end of the thread on the spool of thread supplied in the kit. The loop should be big enough to stick your index finger through. This loop will be the top of the mobile and will serve for connecting to a hook or other fastening means extending downwardly from the ceiling, or other support means for the mobile. Allow for whatever length thread desired for location of the first support rod. This distance may be less, e.g., only about 5", if the mobile is not being suspended from the ceiling.

Continue withdrawing the thread from the spool, as a continuous length, for connection of all the support members, in any vertical alignment, taking into consideration the mobile design selected and the suggested measurements as above disclosed. Referring to FIG. 1(*a*), as an example of construction, sufficient thread should be withdrawn to connect together the three support members located vertically downwardly from ceiling 32. Of course, the length of thread withdrawn will need take into consideration the measurements for the spacing of the clamped pairs of photographs. Where the design includes a photo set as the last vertically aligned member, rather than a support member, the clamping means will be considered as if it were a support member. See, for example, FIG. 1(*b*) wherein the first vertically aligned connecting thread connects a support member and a clamping means.

As the thread is withdrawn from the spool each connection is made to the presented support member. When making this connection wrap the thread as is shown in FIG. 4. This manner of wrapping and connecting the thread to the support member is important, as it makes for a single vertical axis, providing better spin and rotational movement of the mobile.

Once the primary vertical "axis" is connected to all the support members, secondary vertical axes as shown in FIG. 1(*b*) are connected in similar fashion. When the vertical axes are all connected, the photo sets are next connected. Each end of thread is trapped and clipped onto a respective support member and clamp means. Lastly, the support members are capped at the end with end members 28.

When the mobile has been completely assembled on the work surface, e.g., floor, it is then hung from the ceiling or other support member for balancing and making of further adjustments as desired. Balancing is accomplished, in general, by sliding the center (main vertical axis) support member connection, i.e., the clip means, toward the lowest dipping support rod end. This sliding is best accomplished by pinching the thread ends together, i.e., the ends sticking out from the clip means, and pulling the clip means to the right or left on the support member, as necessary. Be careful that the thread does not slip out of the slits in the "C" clip. The spacing between the support members and the support members and clamping means can be also adjusted vertically by sliding them up or down on their connecting threads. Once the mobile is properly balanced, excess thread ends can be trimmed for better appearance.

Quite advantageously other mobile configurations can be created, as desired, as the component of the mobile, in the most preferred embodiment, are re-usable. Or, if desired, other pairs of photographs can be substituted for pairs first used in the mobile construction. In either case, the clamping means are readily removed from a pair of photographs by merely sliding them longitudinally out of the groove. The new pair of photographs is then inserted in the groove. Whether a new mobile configuration is created or pairs of photographs substituted, adjustments will likely need be made for proper balance.

It should be understood that the specific embodiments described herein are merely exemplary of the preferred practice of the present invention and that various modifications and changes may be made in the particular embodiments described herein without departing from the spirit and scope of the present invention. 822-hs

What I claim is:

1. Kit for creation and construction of various designs and configurations of a mobile sculpture displaying a plurality of vertically spaced-apart, suspended in mid-air, planar members of defined shape each having and being defined by at least a top linear edge, said kit comprising a plurality of elongated support members all of the same predetermined length, said support members being characterized by their relative stiffness and resistance to bending when supporting said planar members in the finished mobile sculpture, a plurality of elongated clamping means of predetermined lesser length than said support means each being defined by a rounded "C" cross-section defining an open ended elongated groove for holding and retaining at least one said planar member by its said top linear edge, said clamping means each being characterized by flexibility and shape retention whereby on insertion of the said linear edge of said at least one said planar member longitudinally into an open end of the said elongated groove in said elongated clamping means the ends of the "C" shaped groove will spread apart yet maintain a clamping pressure against the said at least one planar member adjacent to and inwardly from the said top linear edge, and means for connecting together said support members and said elongated clamping means whereby a mobile sculpture of desired spatial configuration can be provided, said connecting means comprising a spool of filamentary material for providing the desired lengths of filamentary material for use in connecting together and suspending the plurality of support members and plurality of elongated clamping means to provide the said planar members in the desired spatial arrangement, and a plurality of clip means each having a rounded "C" shaped cross-section and of somewhat greater dimension than said "C" shaped clamping means, said clip means being characterized by their flexibility and shape retention properties whereby the clip means can be pushed laterally onto said support members and elongated clamping means in conforming, surrounding engagement and used for trapping the ends of the lengths of each length of filamentary material interconnecting a support member, to a support member, or an elongated clamping means to a support member, said trapped ends being free to move relative to a clip means to allow proper spatial adjustment of each said clamped, suspended planar member.

2. Kit for creation and construction of various designs and configurations of a mobile sculpture displaying a plurality of vertically spaced-apart, suspended in mid-air, planar members of defined shape each having and being defined by at least a top linear edge according to claim 1 wherein the said support members are of a rounded cross-sectional shape and the said rounded "C" shaped elongated clamping means are of the same outside diameter as the said support members.

3. Kit for creation and construction of various designs and configurations of a mobile sculpture displaying a plurality of vertically spaced-apart, suspended in mid-air, planar members of defined shape each having and being defined by at least a top linear edge according to claim 1 further comprising a plurality of connecting sleeves for connecting together the ends of two said support members for providing a support member of greater length.

4. Kit for creation and construction of various designs and configurations of a mobile sculpture displaying a plurality of vertically spaced-apart, suspended in mid-air, planar members of defined shape each having and being defined by at least a top linear edge according to claim 1 wherein a plurality of enlargements are provided at predetermined, spaced-apart locations along the said filamentary material.

5. Kit for creation and construction of various designs and configurations of a mobile sculpture displaying a plurality of vertically spaced-apart, suspended in mid-air, planar members of defined shape each having and being defined by at least a top linear edge according to claim 1 wherein said filamentary material comprises a relatively coarse sewing thread which offers resistance to slippage once clipped to a support member and elongated clamping means.

6. Mobile sculpture displaying a plurality of pairs of photographs each of which pair is defined by linear top and bottom edges parallel to one another, suspended in mid-air, and spaced-apart vertically from one another, said sculpture comprising a plurality of horizontally disposed elongated clamping means, each defined by a rounded "C" shaped cross-sectional shape which defines an open-ended, elongated groove extending the length of the clamping means, said "C" shaped clamping means being of a plastic material characterized by sufficient flexibility and original shape retention that the open ends of the "C" shaped clamping means can be yieldingly spread apart by insertion of a pair of photographs at one of the open ends of the clamping means, one each of said clamping means being provided on each said linear edge, said linear edges intruding into said elongated grooves whereby said edges are held in clamping, detachable engagement by said clamping means, a plurality of elongated support members each having a rounded cross-sectional shape and being of a predetermined length greater than that of the said elongated clamping means, a first plurality of predetermined lengths of filamentary material each being attached at one end to one of said clamping means and at the other end to one of said support members, a second plurality of predetermined lengths of filamentary material, each being attached at one end of its length to an elongated support member, and at the other end of its length to another elongated support member, and a plurality of first and second clip means each having a "C" shaped cross-sectional shape defining an inside diameter that approximates the diameters of the support members and clamping means, respectively, and being characterized by sufficient flexibility and shape retention that the ends of the "C" shaped clip means will spread apart allowing the said clip means to be pushed onto a respective support member and clamping means, as desired, a clip means being located on and in conforming relation with the periphery of each said clamping means and said support members at the said ends of the said lengths of the first and second said filamentary material whereby the said ends can be entrapped by said clip means and the said pairs of photographs and support members be maintained in the desired spatial relationship.

* * * * *